United States Patent [19]

Thomas et al.

[11] Patent Number: 5,039,441

[45] Date of Patent: Aug. 13, 1991

[54] SAFE ACIDIC HARD SURFACE CLEANER

[75] Inventors: Michel Thomas, Couthuin; Genevieve Blandiaux, Trooz; Baudouin Valange, Gembloux, all of Belgium

[73] Assignee: Colgate-Palmolive Company, Piscataway, N.J.

[21] Appl. No.: 404,134

[22] Filed: Sep. 7, 1989

Related U.S. Application Data

[63] Continuation of Ser. No. 154,837, Feb. 10, 1988, abandoned.

[51] Int. Cl.[5] ..... C11D 1/12; C11D 1/34; C11D 1/66; C11D 1/83

[52] U.S. Cl. ..... 252/142; 252/136; 252/174.19; 252/526; 252/545; 252/DIG. 14

[58] Field of Search ..... 252/136, 142, 174.19, 252/526, 545, DIG. 14

[56] References Cited

U.S. PATENT DOCUMENTS

| | | | |
|---|---|---|---|
| 3,218,260 | 11/1965 | Lewandowski | 252/142 |
| 3,586,633 | 6/1971 | Schlussler | 252/526 |
| 4,501,680 | 2/1985 | Aszman et al. | 252/DIG. 14 |
| 4,581,161 | 4/1986 | Nedonchelle | 252/142 |
| 4,666,615 | 5/1987 | Disch et al. | 252/529 |

FOREIGN PATENT DOCUMENTS 2106927 4/1983 United Kingdom .

OTHER PUBLICATIONS

McCutcheons, Functional Materials, 1983, p. 68.

*Primary Examiner*—Paul Lieberman
*Assistant Examiner*—J. E. Darland
*Attorney, Agent, or Firm*—Bernard Lieberman; Murray M. Grill; Robert C. Sullivan

[57] ABSTRACT

An acidic aqueous cleaner, preferably in microemulsion form, which is of a pH in the range of one to four and is useful for cleaning hard surfaced items, such as bathtubs, sinks, tiles and porcelains, and even some such items which are not acid resistant, such as those of a European enamel known as zirconium white enamel, comprises synthetic organic detergent, such as a mixture of anionic and nonionic detergents, e.g., sodium paraffin sulfonate, higher fatty alcohol ethoxylate sulfate and higher fatty alcohol or phenol ethoxylate, carboxylic acid, e.g., mixture of succinic, glutaric and adipic acids, and phosphonic acid, e.g., aminotris(methylenephosphonic acid)in an aqueous medium. Preferably a phophoric acid is present to further improve protection of such European enamel surfaces.

The acidic cleaner is useful to remove soap scum, lime scale and grease from surfaces and mentioned items without adversely affecting such surfaces, and removals of the scum, scale and grease is easy, being effected by applying the microemulsion to the surface to be cleaned, followed by wiping it off. Although the cleaned surfaces may be rinsed that is not necessary and the surface will be left clean and shiny after wiping, even without rinsing, or with minimal rinsing.

In the described emulsions the carboxylic acid components effectively remove soap scum and lime scale, the detergents remove greasy soils and promote effective contact between the acid and the surfaces to be treated, and the combination of phosphoric and phosponic acids prevents acidic attack of the dicarboxylic acids on the surface being cleaned, with the phosphoric acid increasing protective action of the phosphonic acid component.

12 Claims, No Drawings

SAFE ACIDIC HARD SURFACE CLEANER

This is a continuation, of application Ser. No. 07/154,837, now abandoned, filed Feb. 10, 1988.

This invention relates to a cleaner for hard surfaces, such as bathtubs, sinks, tiles, porcelain and enamelware, which removes soap scum, lime scale and grease from such surfaces without harming them. More particularly, the invention relates to an acidic microemulsion that can be sprayed onto the surface to be cleaned, and wiped off without usual rinsing, and still leave the cleaned surface bright and shiny. The invention also relates to a method for using such compositions.

Hard surface cleaners, such as bathroom cleaners and scouring cleansers, have been known for many years. Scouring cleansers normally include a soap or synthetic organic detergent or surface active agent, and an abrasive. Such products can scratch relatively soft surfaces and can eventually cause them to appear dull. Also, they are often ineffective to remove lime scale (usually encrusted calcium and magnesium carbonates) in normal use. Because lime scale can be removed by chemical reactions with acidic media various acidic cleaners have been produced, and have met with various degrees of success. In some instances such cleaners have been failures because the acid employed was too strong and damaged the surfaces being cleaned. At other times, the acidic component of the cleaner reacted objectionably with other components of the product, adversely affecting the detergent or perfume, for example. Some cleaners required rinsing afterward to avoid leaving objectionable deposits on the cleaned surfaces. As a result of research performed in efforts to overcome the mentioned disadvantages there has recently been made an improved liquid cleaning composition in stable microemulsion form which is an effective cleaner to remove soap scum, lime scale and greasy soils from hard surfaces, such as bathroom surfaces, and which does not require rinsing after use. Such a product is described in U.S. patent application Ser. No. 120,250, for STABLE MICROEMULSION CLEANING COMPOSITION, filed Nov. 12, 1987, by Loth, Blanvalet and Valange, which application is hereby incorporated by reference. In particular, Example 3 of that application discloses an acidic, clear, oil-in-water microemulsion which is therein described as being successfully employed to clean shower wall tiles of lime scale and soap scum that had adhered to them. Such cleaning was effected by applying the cleaner to the walls, followed by wiping or minimal rinsing, after which the walls were allowed to dry to a good shine.

The described microemulsion cleaner of the patent application is effective in removing lime scale and soap scum from hard surfaces, and is easy to use, but it has been found that its mixture of acidic agents (succinic, glutaric and adipic acids) could damage the surfaces of some hard fixtures, such as those of materials which are not acid resistant. One of such materials is an enamel that has been extensively employed in Europe as a coating for bathtubs, herein referred to as European enamel. It has been described as zirconium white enamel or zirconium white powder enamel, and has the advantage of being resistant to detergents, which makes it suitable for use on tubs, sinks, shower tiles and bathroom enamelware. However, such enamel is sensitive to acids and is severely damaged by use of the microemulsion acidic cleaner based on the three organic carboxylic acids previously mentioned. That problem has been solved by the present invention, in which additional acidic materials are incorporated in the cleaner with the organic acids, and rather than exacerbating the problem, they prevent harm to such European enamel surfaces by such organic acids. Also, a mixture of such additional acids, phosphonic and phosphoric acids, surprisingly further improves the safety of the aqueous cleaner for use on such European enamel surfaces and decreases the cost of the cleaner. Thus, the present invention allows the cleaning by the invented emulsion of European enamel surfaces, as well as any other acid resistant surfaces of bathtubs and other bathroom surfaces However, the product should not be used on various other materials that are especially susceptible to attack by acidic media, such as marble.

In accordance with the present invention an acidic aqueous cleaner for bathtubs and other hard surfaced items, which are acid resistant or are of zirconium white enamel, which cleaner is of a pH in the range of 1 to 4, and which removes lime scale, soap scum and greasy soil from surfaces of such items without damaging such surfaces, comprises: a detersive proportion of synthetic organic detergent, which is capable of removing greasy soil from such surfaces; a lime scale and soap scum removing proportion of dicarboxyl acid(s) having 2 to 10 carbon atoms therein; an aminoalkylenephosphonic acid in such proportion as to prevent damage to zirconium white enamel surfaces of items to be cleaned by the dicarboxylic acid(s) when the cleaner is employed to clean such surfaces; and an aqueous medium for the detergent, dicarboxylic acid(s) and aminoalkylenephosphonic acid.

In the present compositions the synthetic organic detergent may be any suitable anionic, nonionic, amphoteric, ampholytic, zwitterionic or cationic detergent or mixture thereof, but the anionic and nonionic detergents are preferred, as are mixtures thereof. Of the anionics the more preferred are water soluble salts of lipophilic sulfonic and sulfuric acids, the lipophilic moieties of which include long chain aliphatic groups, preferably lomg chain alkyls, of 8 to 20 carbon atoms, more preferably of 12 to 18 carbon atoms. Although several different types of solubilizing cations may be present in the detergents it will usually be preferred that they be alkali metal, e.g., sodium or potassium or a mixture thereof, ammonium, or lower alkanolamine, of 2 or 3 carbon atoms per alkanol moiety. It is a desirable feature of the present invention that sodium may be the alkali metal employed, and the emulsions resulting will be stable and effective.

Much preferred salts of lipophilic sulfonic acids are paraffin sulfonates, wherein the paraffin group is of 12 to 18 carbon atoms, preferably 14 to 17 carbon atoms. Other useful sulfonates are olefin sulfonates wherein the olefin starting material is of 12 to 18 carbon atoms, e.g., 12 to 15, and linear alkylbenzene sulfonates wherein the alkyl is of 12 to 18 carbon atoms, preferably of 12 to 16 carbon atoms, e.g., 12 or 13. All such sulfonates will preferably be employed as their sodium salts, but other salts are also operative.

Much preferred salts of lipophilic sulfuric acids are of higher alkyl ethoxylate sulfuric acids, which may also be designated as higher alkyl ethyl ether sulfuric acids. The higher alkyls of such compounds are of the chain lengths given above for this class of anionic detergents, 10 to 18 carbon atoms, and preferably are of 10 to 14 carbon atoms, e.g., 12 or about 12 carbon atoms. Such compounds should include from 1 to 10 ethylene oxide groups per mole, preferably 3 to 7 ethylene oxide groups per mole, e.g., 5. A preferred cation is sodium but the cations mentioned above for solubilizing functions may be employed in suitable circumstances.

The nonionic detergents that are useful in this invention may be any of the nonionic detergents known to the art (as may be the anionic detergents that satisfy the conditions set in this specification). Many such detergents are described in the text *Surface Active Agents (Their Chemistry and Technology)* by Schwartz and Perry, and in the various annual editions of John W. McCutcheon's *Detergents and Emulsifiers.* However, they will usually be condensation products of a lipophilic moiety, such as a higher alcohol or phenol, or a propylene glycol or propylene oxide polymer, with ethylene oxide or ethylene glycol In some of the condensation products of ethylene oxide and higher fatty alcohol or alkyl substituted phenol (in which the alkyl on the phenol nucleus is usually of 7 to 12 carbon atoms, preferably 9), some propylene oxide may be blended with the ethylene oxide so that the lower alkylene oxide moiety in the nonionic detergent is mixed, whereby the hydrophilic-lipophilic balance (HLB) may be controlled.

Much preferred nonionic detergents present in the invented emulsions will be condensation products of a fatty alcohol of 8 to 20 carbon atoms with from 3 to 20 moles of ethylene oxide, preferably of a linear alcohol of 9 to 15 carbon atoms, such as 9–11 or 11–13 carbon atoms or averaging about 10 or 12 carbons, with 3 to 15 moles of ethylene oxide, such as 3–7 or 5–9 moles of ethylene oxide, e.g., about 5 or 7 moles thereof. In place of the higher fatty alcohol one may use an alkylphenol, such as one of 8 to 10 carbon atoms in a linear alkyl, e.g., nonylphenol, and the phenol may be condensed with from 3 to 20 ethylene oxide groups, preferably 8 to 15. Similarly functioning nonionic detergents that are polymers of mixed ethylene oxide and propylene oxide may be substituted, at least in part, for the other nonionics Among such are those sold under the trademark Plurafac, such as Plurafac® RA-30 and Plurafac LF-400, available from BASF. Preferred such nonionics contain 3 to 10 ethoxies, more preferably about 7, and 2 to 7 propoxy groups, more preferably about 4, and such are condensed with a higher fatty alcohol of 12–16, more preferably 13–15 carbon atoms to make a mole of nonionic detergent.

The various nonionic detergents, and the anionic detergent are often mixtures, which are within singular designations herein.

The active acidic component of the emulsions is a carboxylic acid which is strong enough to lower the pH of the emulsion to one in the range of one to four. Various such carboxylic acids can perform this function but those which have been found effectively to remove soap scum and lime scale from bathroom surfaces best, while still not destabilizing the emulsion, are polycarboxylic acids, and of these the dicarboxylic acids are preferred. Of the dicarboxylic acids group, which includes those of 2 to 10 carbon atoms, from oxalic acid through sebacic acid, suberic, azelaic and sebacic acids are of lower solubilities and therefore are not as useful in the present emulsions as the other dibasic aliphatic fatty acids, all of which are preferably saturated and straight chained. Oxalic and malonic acids, although useful as reducing agents too, may be too strong for delicate hard surface cleanings. Preferred such dibasic acids are those of the middle portion of the 2 to 10 carbon atom acid range, succinic glutaric, adipic and pimelic acids, especially the first three thereof, which fortunately are available commercially, in mixture. The diacids, after being incorporated in the invented emulsion, may be partially neutralized to produce the desired pH in the emulsion, for greatest functional effectiveness, with safety.

Phosphoric acid is one of the additional acids that helps to protect acid-sensitive surfaces being cleaned with the present emulsion cleaner. Being a tribasic acid, it too may be partially neutralized to obtain an emulsion pH in the desired range. For example, it may be partially neutralized to the biphosphate, e.g., $NaH_2PO_4$, or $NH_4H_2PO_4$.

Phosphonic acid, the other of the two additional acids for protecting acid-sensitive surfaces from the dissolving action of the dicarboxylic acids of the present emulsions, apparently exists only theoretically, but its derivatives are stable and are useful in the practice of the present invention. Such are considered to be phosphonic acids, as that term is used in this specification. The phosphonic acids are of the structure

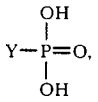

wherein Y is any suitable substituent, but preferably Y is alkylamino or N-substituted alkylamino. For example, a preferred phosphonic acid component of the present emulsions is aminotris-)methylenephosphonic) acid, which is of the formula $N(CH_2PH_2O_3)$. Among other useful phosphonic acids are ethylenediamine tetra-(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogens, 3 or 4 lower alkylenephosphonic acid groups in which the lower alkylene is of 1 or 2 carbon atoms, and 0 to 2 alkylene groups of 2 to 6 carbon atoms each, which alkylene(s) is/are present and join amino nitrogens when a plurality of such amino nitrogens is present in the aminoalkylenephosphonic acid. It has been found that such aminoalkylenephosphonic acids, which also may be partially neutralized at the desired pH of the microemulsion cleaner, are of desired stabilizing and protecting effect in the invented cleaner, especially when present with phosphoric acid, preventing harmful attacks on European enamel surfaces by the diacid(s) components of the cleaner. Usually the phosphorus acid salts, if present, will be mono-salts of each of the phosphoric and/or phosphonic acid groups present.

The water that is used in making the present microemulsions may be tap water but is preferably of low hardness, normally being less than 150 parts per million (p.p.m.) of hardness, as calcium carbonate. Still, useful cleaners can be made from tap waters that are higher in hardness, up to 300 p.p.m., as $CaCO_3$. Most preferably the water employed will be distilled or deionized water, in which the content of hardness ions is less than 25 p.p.m., usually being nil. Employment of such deionized water allows for the manufacture of a product of consistently good qualities, independent of hardness variations in the aqueous medium.

Various other components may desirably be present in the invented cleaners, including preservatives, antioxidants or corrosion inhibitors, cosolvents, cosurfactants, multivalent metal ions, perfumes, colorants and terpenes (and terpineols), but various other adjuvants conventionally employed in liquid detergents and hard surface cleaners may also be present, provided that they do not interfere with the cleaning and scum- and scale-removal functions of the cleaner. Of the various adjuvants (which are so identified because they are not necessary for the production of an operative cleaner, although they may be very desirable components of the cleaner) the most important are considered to be the perfumes, which, with terpenes, terpineols and hydrocarbons (which may be substituted for the perfumes or added to them) function as especially effective solvents for greasy soils on hard surfaces being cleaned, and form the dispersed phases of oil-in-water (o/w) microemulsions Also of functional importance are the co-surfactant and polyvalent metal ions, with the former helping to stabilize the microemulsion and the latter aiding in improving detergency, especially for more dilute cleaners, and when the polyvalent salts of the anionic detergent employed are more effective detergents against the greasy soil encountered in use.

The various perfumes that have been found to be useful in forming the dispersed phase of the o/w microemulsion cleaners may be those normally employed in cleaning products, and preferably are normally in liquid state. They include esters, ethers, aldehydes, alcohols and alkanes employed in perfumery but of most importance are the essential oils that are high in terpene content. It appears that the terpenes (and terpineols) coact with the detersive components of microemulsions to improve detergency of the invented compositions, in addition to forming the stable dispersed phase of the microemulsions. In the present invention it has been found that especially when a piney perfume is being employed, one can decrease the proportion of comparatively expensive such perfume and can compensate for it with alpha-terpineol, and in some instances with other terpenes. For example, for every 1% of perfume one can substitute from 60 to 90% of it, e.g., about 80%, with alpha-terpineol, and obtain essentially the same piney scent, with good cleaning and microemulsion stability. Similarly, terpenes and other terpene-like compounds and derivatives may be employed, but alpha-terpineol is considered to be the best.

The polyvalent metal ion present in the invented cleaners may be any suitable such ion, including magnesium (usually preferred), aluminum, copper, nickel, iron or calcium, and the ion or mixture thereof may be added in any suitable form, sometimes as an oxide or hydroxide, but usually as a water soluble salt. It appears that the polyvalent metal ion reacts with the anion of the anionic detergent (or replaces the detergent cation, or makes an equivalent solution in the emulsion), which improves detergency and generally improves other properties of the product too. If the polyvalent metal ion reacts with the detergent anion to form an insoluble product such polyvalent ion should be avoided. For example, calcium reacts with paraffin sulfonate anion to form an insoluble salt, so calcium ions, such as might be obtained from calcium chloride, will be omitted from any emulsion cleaners of this invention that contain paraffin sulfonate detergent. Similarly, those polyvalent ions or other components of the invented compositions that will react adversely with other components will also be omitted. As was mentioned previously, the polyvalent metal ion will preferably be magnesium, and such will be added to the other emulsion components as a water soluble salt. A preferred such salt is magnesium sulfate, usually employed as its heptahydrate (Epsom salts), but other hydrates thereof or the anhydride may be used too. Generally, the sulfates of the polyvalent metals will be used because the sulfate anion thereof is also the anion of some of the anionic detergents and is found in some such detergents as a byproduct of neutralization.

The cosurfactant component(s) of the microemulsion cleaners reduce the interfacial tension or surface tension between the lipophilic droplets and the continuous aqueous medium to a value that is often close to $10^{-3}$ dynes/cm , which results in spontaneous disintegrations of the dispersed phase globules until they become so small as to be invisible to the human eye, forming a clear microemulsion. In such a microemulsion the surface area of the dispersed phase increases greatly and its solvent power and grease removing capability are also increased, so that the microemulsion is significantly more effective as a cleaner for removing greasy soils than when the dispersed phase globules are of ordinary emulsion size. Among the cosurfactants that are useful in the invented cleaners are: water soluble lower alkanols of 2 to 4 carbon atoms per molecule (sometimes preferably 3 or 4); polypropylene glycols of 2 to 18 propoxy units; monoalkyl lower glycol ethers of the formula $RO(X)_nH$ , wherein R is $C_{1-4}$ alkyl, X is $CH_2CH_2O$, $CH_2CH_2CH_2O$ or $CH(CH_3)CH_2O$, and n is from 1 to 4; monoalkyl esters of the formula $R^1O(X)_nH$ wherein $R^1$ is $C_{2-4}$ acyl and X and n are as immediately previously described; aryl substituted alkanols of 1 to 4 carbon atoms; propylene carbonate; aliphatic mono-, di- and tricarboxylic acids of 3 to 6 carbon atoms; mono-, di- and tri hydroxy substituted aliphatic mono-, di- and tricarboxylic acids of 3 to 6 carbon atoms; higher alkyl ether poly-lower alkoxy carboxylic acids; lower alkyl mono-, di- and triesters of phosphoric acid wherein the lower alkyl is of 1 to 4 carbon atoms; and mixtures thereof.

Representative of such cosurfactants are succinic, glutaric and adipic acids, diethylene glycol monobutyl ether, dipropylene glycol monobutyl ether and diethylene glycol monoisobutyl ether, which are considered to be the most effective.

From the foregoing discussion of useful cosurfactants in the present cleaners it is apparent that succinic, glutaric and adipic acids, and a mixture of such components, are useful for lowering the pH of the product so that it removes soap scum and lime scale easily from surfaces to be cleaned, and at the same time they function as cosurfactants, improving the appearance of the product and making it more effective for removing grease from such surfaces. Similar dual effects may be obtained by use of others of the named acidic materials that have cosurfactant activities in the described cleaners.

Although it is highly preferred that the present cleaning compositions be in the form of aqueous microemulsions it is within the invention to utilize less preferred emulsions (wherein the dispersed phase globules are larger in sizes), but in such cases the cleaning power of the product will be less because there will not be as good contact of the cleaner with the surface being treated. Also, although microemulsions are highly preferred embodiments of the invention, other emulsions and other forms of the composition may be used, such as gels, pastes, solutions, foams, and "aerosols", which include aqueous media.

In the invented cleaners it is important that the proportions of the components are in certain ranges so that the product may be most effective in removing greasy soils, lime scale and soap scum, and other deposits from the hard surfaces subjected to treatment, and so as to protect such surfaces during such treatment. As was previously referred to, the detergent should be present in detersive proportion, sufficient to remove greasy and oily soils; the proportion(s) of carboxylic acid(s) should be sufficient to remove soap scum and lime scale; the phosphonic acid or phosphoric and phosphonic acids mixture should be enough to prevent damage of acid sensitive surfaces by the carboxylic acid(s); and the aqueous medium should be a solvent and suspending medium for the required components and for any adjuvants that may be present, too. Normally, such percentages of components will be 2 to 8% of synthetic anionic organic detergent(s), 1 to 6% of synthetic organic nonionic detergent(s), 2 to 6% of aliphatic carboxylic acids (preferably diacids), 0.05 to 5% of phosphoric acid or mono-salt thereof, and 0.005 to 2% of phosphonic acid(s), aminoalkylenephosphonic acid(s), or monophosphonic salt(s) thereof; and the balance water and adjuvant(s), if any are present. Of the carboxylic acids it is preferred that a mixture of succinic, glutaric and adipic acids be employed, and the ratio thereof will most preferably be in the range of 1–3:1–6:1–2, with 1:1:1 and about 2:5:1 ratios being most preferred. The ratios of phosphonic acid (preferably aminoalkylenephosphonic acid) to phosphoric acid to aliphatic carboxylic diacids (or carboxylic acids) are usually about 1:1–20:20–500, preferably being 1:2–10:10–200, and more preferably being about 1:4:25, 1:7:170 and 1:3:25, in three representative formulas However, one may have ranges as wide as 1:1–2,000:10–4,000 and sometimes the preferred range of phosphonic acid to dicarboxylic acid is 5:1 to 250:1. Similarly, a mixture of succinic, glutaric and adipic acids may be of ratio of 0.8–4:0.8–10:1.

Usually there will be present in the cleaner, especially when paraffin sulfonate is the detergent, 0.05 to 5%, and preferably 0.1 to 0.3% of polyvalent ion, preferably magnesium or aluminum, and more preferably magnesium. Also, the percentage of perfume will normally be in the 0.2 to 2% range, preferably being in the 0.5 to 1.5% range, of which perfume at least 0.1% is terpene or terpineol. The terpineol is alpha-terpineol and is preferably added to allow a reduction in the amount of perfume, with the total perfume (including the alpha-terpineol) being 50 to 90% of terpineol, preferably about 80% thereof.

For preferred formulas of the present cleaners, which are different in that one contains two anionic detergents and the other only one, the latter will contain 3 to 5% of sodium paraffin sulfonate wherein the paraffin is $C_{14-17}$, 2 to 4% of nonionic detergent which is a condensation product of a fatty alcohol of 9 to 15 carbon atoms with 3 to 15 moles of ethylene oxide per mole of higher fatty alcohol, 3 to 7% of a 1:1:1 or 2:5:1 mixture of succinic glutaric and adipic acids, 0.1 to 0.3% of phosphoric acid, 0.03 to 0.1% of aminotris-(methylenephosphonic acid), 0.1 to 0.2% of magnesium ion, 0.5 to 2% of perfume, of which 50 to 90% thereof is alpha-terpineol, 0 to 5% of adjuvants and 75 to 90% of water. More preferably, such cleaner will comprise or consist essentially of about 4% of sodium paraffin ($C_{14-17}$) sulfonate, about 3% of the nonionic detergent, about 5% of 2:5:1 mix ofthedicarboxylic acids, about 0.2% of phosphoric acid, about 0.05% of aminotris-(methylenephosphonic acid), about 1% of perfume, which includes about 0.8% of alpha-terpineol, about 0.7% of magnesium sulfate (anhydrous), about 3% of adjuvants and about 83% of water.

The other preferred formula comprises 0.5 to 2% of sodium paraffin sulfonate wherein the paraffin is $C_{14-17}$, 2 to 4% of sodium ethoxylated higher fatty alcohol sulfate wherein the higher fatty alcohol is of 10 to 14 carbon atoms and which contains 1 to 3 ethylene oxide groups per mole, 2 to 4% of nonionic detergent which is a condensation product of fatty alcohol of 9 to 15 carbon atoms with 3 to 15 moles of ethylene oxide per mole of fatty alcohol 3 to 7% of a 1:1:1 mixture of succinic, glutaric and adipic acids, 0.1 to 0.3% of phosphoric acid, 0.01 to 0.05% of aminotris-(methylenephosphonic acid), 0.09 to 0.17% of magnesium ion, 0.5 to 2% of perfume, of which at least 10% is terpene(s) and/or terpineol, 0 to 5% of adjuvant(s) and 75 to 90% of water. More preferably, such cleaner, with two anionic detergents, will comprise or consist essentially of about 1% of sodium paraffin ($C_{14-17}$) sulfonate, about 3% of sodium ethoxylated higher fatty alcohol sulfate wherein the higher fatty alcohol is lauryl alcohol and the degree of ethoxylation is 2 moles of ethylene oxide per mole, about 3% of nonionic detergent which is a condensation product of a $C_{9-11}$ linear alcohol and 5 moles of ethylene oxide, about 5% of a 1:1:1 mixture of succinic, glutaric and adipic acids, about 0.2% of phosphoric acid, about 0.03% of aminotris-(methylenephosphonic acid) about 0.7% of magnesium sulfate (anhydrous), about 2% of adjuvants and about 84% of water.

The pH of the various preferred microemulsion cleaners is usually 1–4, preferably 1.5–3.5, e.g. 3. The water content of the microemulsions will usually be in the range of 75 to 90%, preferably 80 to 85%, and the adjuvant content will be from 0 to 5%, usually 1 to 3%. If the pH is not in the desired range it will usually be adjusted with either sodium hydroxide or suitable acid, e.g., sulfuric acid, solutions, but normally the pH will be raised, not lowered, and if it is to be lowered more of the dicarboxylic acid mixture can be used, instead.

The cleaners of the invention, in microemulsion form, are clear o/w emulsions and exhibit stability at room temperature and at elevated and reduced temperatures, from 10° to 50° C. They are readily pourable and exhibit a viscosity in the range of 2 to 150 or 200 centipoises, e.g., 5 to 40 cp., as may be desired, with the viscosity being controllable, in part, by addition to the formula of a thickener, such as lower alkyl celluloses, e.g., methyl cellulose, hydroxypropyl methyl cellulose, or water soluble resin, e.g., polyacrylamide, polyvinyl alcohol. Any tendency of the product to foam objectionably can be counteracted by incorporating in the formula free fatty acid or soap, in minor proportion, as is known in the detergent art (at low pH the soap turns to acid).

The liquid cleaners can be manufactured by mere mixing of the various components thereof, with orders of additions not being critical. However, it is desirable for the various water soluble components to be mixed together, the oil soluble components to be mixed together in a separate operation, and the two mixes to be admixed, with the oil soluble portion being added to the water soluble portion (in the water) with stirring or other agitation. In some instances such procedure may be varied to prevent any undesirable reactions between components. For example, one would not add concentrated phosphoric acid directly to magnesium sulfate or to a dye, but such additions would be of aqueous solutions, preferably dilute, of the components.

The cleaner may desirably be packed in manually operated spray dispensing containers, which are usually and preferably made of synthetic organic polymeric plastic material, such as polyethylene, polypropylene or polyvinyl chloride (PVC). Such containers also preferably include nylon or other non-reactive plastic closure, spray nozzle, dip tube and associated dispenser parts, and the resulting packaged cleaner is ideally suited for use in "spray and wipe" applications. However, in some instances, as when lime scale and soap scum deposits are heavy, the cleaner may be left on until it has dissolved or loosened the deposits, and may then be wiped off, or may be rinsed off, or multiple applications may be made, followed by multiple removals, until the deposits are gone. For spray applications the viscosity of the microemulsion (or ordinary emulsion, if that is used instead) will desirably be increased so that the liquid adheres to the surface to be cleaned, which is especially important when such surface is vertical, to prevent immediate run-off of the cleaner and consequent loss of effectiveness. Sometimes, the product may be formulated as an "aerosol spray type", so that its foam discharged from the aerosol container will adhere to the surface to be cleaned. At other times the aqueous medium may be such as to result in a gel or paste, which is deposited on the surface by hand application, preferably with a sponge or cloth, and is removed by a combination of rinsing and wiping, preferably with a sponge, after which it may be left to dry to a shine, or may be dried with a cloth. Of course, when feasible, the cleaned surface may be rinsed to remove all traces of acid from it.

The following examples illustrate but do not limit the invention. All parts, proportions and percentages in the examples, the specification and claims are by weight and all temperatures are in °C. unless otherwise indicated.

EXAMPLE 1

| Component | % (by weight) |
|---|---|
| Sodium paraffin sulfonate (paraffin of $C_{14-17}$) | 1.00 |
| Sodium lauryl ether sulfate (2 moles of ethylene oxide [EtO] per mole) | 3.00 |
| $C_{9-11}$ linear alcohol ethoxylate nonionic detergent (5 moles of EtO per mole) | 3.00 |
| Magnesium sulfate heptahydrate (Epsom salts) | 1.35 |
| Succinic Acid | 1.67 |
| Glutaric Acid | 1.67 |
| Adipic Acid | 1.67 |
| Aminotris (methylenephosphonic acid) | 0.03 |
| Phosphoric Acid | 0.20 |
| Perfume (contains about 40% terpenes) | 1.00 |
| Dye (1% aqueous solution of blue dye) | 0.10 |
| Sodium hydroxide (50% aqueous solution: decrease water amount by amount of NaOH solution used) | q.s. |
| Water (deionized) | 85.31 |
| | 100.00 |

The microemulsion cleaner is made by dissolving the detergents in the water, after which the rest of the water soluble materials are added to the detergent solution, with stirring, except for the perfume and the pH adjusting agent (sodium hydroxide solution). The pH is adjusted to 3.0 and then the perfume is stirred into the aqueous solution, instantaneously generating the desired microemulsion, which is clear blue, and of a viscosity in the range of 2–20 cp. If the viscosity is lower or if it is considered desirable for it to be increased there may be incorporated in the formula about 0.1 to 1% of a suitable gum or resin, such as sodium carboxymethyl cellulose or hydroxypropylmethyl cellulose, or polyacrylamide or polyvinyl alcohol, or a suitable mixture thereof.

The acid cleaner is packed in polyethylene squeeze bottles equipped with polypropylene spray nozzles, which are adjustable to closed, spray and stream positions. In use, the microemulsion is sprayed onto "bathtub ring" on a bathtub, which also includes lime scale, in addition to soap scum and greasy soil. The rate of application is about 5 ml. per 5 meters of ring (which is about 3 cm. wide). After application and a wait of about two minutes the ring is wiped off with a sponge and is sponged off with water. It is found that the greasy soil, soap scum, and even the lime scale, have been removed effectively. In those cases where the lime scale is particularly thick or adherent a second application may be desirable, but that is not considered to be the norm.

The tub surface may be rinsed because it is so easy to rinse a bathtub (or a shower) but such rinsing is not necessary. Sometimes dry wiping will be sufficient but if it is desired to remove any acidic residue the surface may be sponged with water or wiped with a wet cloth but in such case it is not necessary to use more than ten times the weight of cleaner applied. In other words, the surface does not need to be thoroughly doused or rinsed with water, and it still will be clean and shiny (providing that it was originally shiny). In other uses of the cleaner, it may be employed to clean shower tiles, bathroom floor tiles, kitchen tiles sinks and enamelware, generally, without harming the surfaces thereof. It is recognized that many of such surfaces are acid-resistant but a commercial product must be capable of being used without harm on even less resistant surfaces, such as European white enamel (often on a cast iron or sheet steel base), which is sometimes referred to as zirconium white powder enamel. It is a feature of the cleaner described above (and other cleaners of this invention) that they clean hard surfaces effectively, but they do contain ionizable acids and therefore should not be applied to acid-sensitive surfaces Nevertheless, it has been found that the do not harm European white enamel bathtubs, in this example, which are seriously affected by cleaning with preparations exactly like that of this example except for the omission from them of the phosphonic acid or the phosphonic-phosphoric acid mixture.

The major component of the formulation that protects the European enamels is the phosphonic acid, and in the formula the amount of such acid has been reduced below the minimum normally required at a pH of 3. Yet, although 0.5% is the minimum normally, when the phosphoric acid is present, which is ineffective in itself at such pH, it increases the effect of the phosphonic acid, allowing a reduction in the proportion of the more expensive phosphonic acid.

In variations of the described formula, all components are kept the same and in the same proportions except for water, and phosphonic and phosphoric acids. In Experiment la, 0.05% of aminotris-(methylenephosphonic acid) is employed and the phosphoric acid is omitted; in Experiment lb, 0.5% of ethylene diamine tetra(methylenephosphonic acid) is employed, with no phosphoric acid; in Experiment 1c, 0.5% of hexamethylene diamine tetra-(methylenephosphonic acid) is used, with no phosphoric acid; in Experiment 1d 0.4% of diethylene triamine penta-(methylenephosphonic acid) is present, without phosphoric acid; and in Experiment 1e, 0.10% of diethylene triamine penta-(methylenephosphonic acid) is employed, with 0.60% of phosphoric acid. The cleaning powers of formulas 1d and 1e are about equivalent, showing that the presence of the phosphoric acid, essentially inactive as a protector of surfaces against the effects of the carboxylic acids present in the formula, decreases the proportion of phosphonic acid to protect the surfaces to ¼ of that previously necessary. Similar effects are obtainable when phosphoric acid is used in the 1b and 1c formulas in about the same proportions as in Example 1 and Example 1e. If excessive foaming is encountered in use of the cleaner one may add an anti-foaming agent such as a silicone or a coco fatty acid. Alternatively, coco-diethanolamide may be added to increase foaming.

EXAMPLE 2

| Component | % (by weight) |
|---|---|
| Sodium paraffin sulfonate ($C_{14-17}$ paraffin) | 4.00 |
| Nonionic detergent (condensation product of one mole of fatty $C_{9-11}$ alcohol and 5 moles EtO) | 3.00 |
| Magnesium sulfate heptahydrate | 1.50 |
| Mixed succinic, glutaric and adipic acids (1:1:1) | 5.00 |
| Aminotris-(methylenephosphonic acid) | 0.03 |
| Phosphoric acid | 0.20 |
| Perfume | 1.00 |
| Dye (1% aqueous solution of blue dye) | 0.05 |
| Sodium hydroxide (50% aqueous solution; decrease water amount by amount of NaOH solution used) | q.s. |
| Water, deionized | 85.22 |
| | 100.00 |

The compositions of this example are made in the same manner as those of Example 1 and are tested in the same way, too, with similar good results. The microemulsions are a clear lighter blue and the pH thereof is adjusted to 3.0. The cleaners easily remove soap scum and greasy soils from hard surfaces and loosen and facilitate removal of lime scale, too, with minimal rinsing or spongeing, as reported in Example 1. The presence of the aminotris-(methylenephosphonic acid) prevents harm to the acid sensitive surfaces by the carboxylic acids, and the presence of the phosphoric acid allows reduction in the proportion of aminotris-(methylenephosphonic acid) used. For example, in Example 2a, without any phosphoric acid present, it takes 0.10% of the aminotris-(methylenephosphonic acid) to prevent harm to European enamel by the cleaning composition. Similarly, in Example 1b, wherein the formula is the same except that the phosphonic and phosphoric acids are replaced by 0.20% of phosphonic acid (diethylene triamine penta-(methylenephosphonic acid) and 0.6% of phosphoric acid, European enamel is unharmed, whereas to obtain the same desirable effect without the phosphoric acid present required 0.50% of the phosphonic acid. Similar results are obtained when the 0.5% of the phosphonic acid is replaced by the same proportion of ethylene fiamine tetra-(methylenephosphonic acid) or hexamethylene diamine tetra-(methylenephosphonic acid), with and without supplemental phosphoric acid.

Thus, from this example (and Example 1) it is seen that phosphoric acid, which is essentially ineffective to protect acid-sensitive surfaces against actions of carboxylic acids in the present cleaners, improves the protective effects of phosphonic acids, and does so significantly for European bathtub enamel.

EXAMPLE 3

| Component | % (by weight) |
|---|---|
| Deionized water | 82.339 |
| $C_{14-17}$ paraffin sodium sulfonate (60% active, Hostapur SAS) | 6.670 |
| *Mixture of Glutaric, succinic and adipic acids (mf'd. by GAF Corp.) | 5.000 |
| Nonionic detergent (Plurafac RA-30, ethoxypropoxy higher fatty alcohol, mf'd. by BASF-Wyandotte) | 3.000 |
| Epsom salts | 1.500 |
| Aminotris-(methylenephosphonic acid) | 0.050 |
| Phosphoric acid (85%) | 0.230 |
| Perfume (pine scent type, containing terpenes) | 0.200 |
| Alpha-terpineol (perfume substitute) | 0.800 |
| Formalin (preservative) | 0.200 |
| 2,6-Di-tert-butyl-para-cresol (antioxidant) | 0.010 |
| CI Acid Blue 104 dye | 0.001 |
| | 100.000 |

*57.5% glutaric acid, 27% succinic acid and 12% of adipic acid

The above formula is made in the manner previously described and is similarly tested and found satisfactorily to clean acid sensitive hard surfaced items, such as tubs and sinks of cast iron or sheet steel coated with European enamel, of greasy soils on them, and to facilitate removals of soap scums and lime scales from such surfaces. When the phosphonic and phosphoric acids are omitted from the formula, or when only the phosphonic acid is omitted, the cleaner attacks such surfaces and dissolves them. The presence of the phosphoric acid allows a reduction in the proportion of the phosphonic acid that is required to inhibit the cleaner so that it will not attack the European enamels, and that reduction is significant, especially for economic reasons, but also functionally. The alpha-terpineol replaces some of the perfume and helps in the formation of the microemulsion, while not destroying the pleasant scent that the perfume imparts to the product, and such results are obtainable with other pine-type perfumes. The alpha-terpineol, like the terpene components of a pine-type perfume, facilitates microemulsion formation, but the terpineol is even more active because it is essentially 100% of terpene type compound, whereas the perfumes are usually less than 50% of terpenes.

EXAMPLE 4

When variations are made in the formulas given above, by substituting different anionic and nonionic detergents, of types described herein, by utilizing other polyvalent salts (or omitting them), by employing other phosphonic acids, with or without phosphoric acid, and by varying the proportions of components ±10%, 20% and 30%, within the ranges given in the specification, useful microemulsion cleaners are obtainable that will satisfactorily clean hard surfaces and remove soap scum and lime scale from them, without damaging them, even when they are of European enamel. The products preferably contain phosphoric acid, which improves the protective action of the phosphonic acid component, but it is within the invention to omit the phosphoric acid, if that is considered to be desirable and feasible. The cleaners are preferably in microemulsion form but even if the microemulsion should "break" to an ordinary emulsion the product will be useful as an effective cleaner, so such emulsions are also within the invention. It may be preferred to dispense the cleaner from a spray bottle but it can be packaged in conventional bottles, also. It may be made in paste or gel form so as to make it more adherent to surfaces to which it is applied, so that it will remain on them, working to attack the lime scale, rather than running down off the surface. Furthermore, while mixtures have been mentioned in this specification, even where they were not specifically referred to it should be considered that mention of a single component includes reference to mixtures of such components in the invented cleaners.

This invention has been described with respect to illustrations and embodiments thereof but it is not to be limited to them because one of ordinary skill in the art will be able, with the benefit of applicants' teaching before him/her, to utilize substitutes and equivalents without departing from the invention.

What is claimed is:

1. An acidic aqueous cleaner for bathtubs and other hard surfaced items, which ar acid resistant or are of zirconium white enamel, which cleaner is of a pH in the range of 1 to 4, and which removes lime scale, soap scum and greasy soil from surfaces of such items without damaging such surfaces, which comprises 2 to 8% of synthetic organic anionic detergent(s) selected from the group consisting of water soluble salts of lipophile sulfonic and sulfuric acids, 1 to 6% of synthetic organic nonionic detergent(s) selected from the group of condensation products of ethylene oxide or ethylene glycol with a lipophilic moiety which is a higher alcohol, phenol, propylene oxide polymer or propylene glycol polymer, 2 to 10% of aliphatic carboxylic diacid(s) of 4 to 7 carbon atoms, 0.05 to 1% of phosphoric acid and 0.01 to 0.2% of aminoalkylenephosphonic acid(s) of the formula

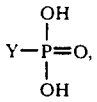

wherein Y is alkylamino or N-substituted alkylamino, which aminoalkylenephosphonic acid contains in the range of 1 to 3 amino nitrogen(s), 3 or 4 lower alkylenephosphonic acid groups, in which the lower alkylene is of 1 or 2 carbon atoms, and 0 to 2 aklylene groups of 2 to 6 carbon atoms each of groups joins amino nitrogens when a plurality of such amino nitrogens is present in the aminoalkylenephosphonic acid.

2. An acidic aqueous cleaner according to claim 1 wherein the dicarboxylic acid(s) is/are aliphatic and of carbon atoms content in the range of 3 to 8, the aminoalkylenephosphonic acid contains 1 to 3 amino nitrogen(s), 3 or 4 lower alkylene phosphonic acid groups and 0 to 2 lower alkylene groups of 2 to 6 carbon atoms each, which alkylene(s) is/are present and connect(s amino nitrogens when a plurality of such nitrogens is present in the aminoalkylenephosphonic acid.

3. An acidic aqueous emulsion cleaner according to claim 2, which is in liquid emulsion form and in which the ratio of dicarboxylic acid to aminoalkylenephosphonic acid is in the range of 5:1 to 250:1.

4. An acidic aqueous emulsion cleaner according to claim 3 wherein the aminoalkylenephosphonic acid is selected from the group consisting of aminotris-(methylenephosphonic acid), ethylenediamine tetra-(methylenephosphonic acid), hexamethylene diamine tetra-(methylenephosphonic acid), and diethylenetriamine penta-(methylenephosphonic acid), and mixtures thereof.

5. An acidic aqueous emulsion liquid cleaner according to claim 1 in which the proportion of phosphoric acid is in the range of 2:1 to 10:1 with respect to the aminoalkylenephosphonic acid and the ratio of dicarboxylic acid to phosphoric acid is in the range of 5:2 to 25:1.

6. An acidic liquid emulsion cleaner according to claim 1 wherein the synthetic organic anionic detergent is selected from the group consisting of water soluble higher paraffin sulfonate and water soluble ethoxylated higher fatty alcohol sulfate having 1 to 10 ethylene oxide groups per mole, and mixtures thereof, the nonionic detergent is a condensation product of a fatty alcohol of 9 to 15 carbon atoms with from 3 to 15 moles of lower alkylene oxide per mole of higher fatty alcohol, the diacid(s) is a mixture of succinic, glutaric and adipic acids is proportions of 0.8–4:0.8–10:1; the aminoalkylenephosphonic acid is aminotris-(methylenephosphonic acid).

7. An acidic liquid microemulsion cleaner according to claim 6 which is of a pH in the range of 2.5 to 3.5 and which comprises 3 to 5% of sodium paraffin sulfonate wherein the paraffin is $C_{14-17}$, 2 to 4% of nonionic detergent which is a condensation product of a fatty alcohol of 9 to 15 carbon atoms with 3 to 15 moles of lower alkylene oxide per mole of higher fatty alcohol, 3 to 7% of the mixture of succinic, glutaric and adipic acids, 0.1 to 0.3% of phosphoric acid, 0.03 to 0.1% of aminotris-(methylenephosphonic acid), 0.1 to 0.2% of magnesium ion, 0.5 to 2% of perfume, of which 50 to 90% thereof is alpha-terpineol, 0 to 5% of adjuvants and 75 to 90% of water.

8. An acidic liquid microemulsion cleaner according to claim 7 which comprises about 4% of sodium paraffin sulfonate, about 3% of nonionic detergent, about 5% of about a 2:5:1 mixture of succinic, glutaric and adipic acids, about 0.2% of phosphoric acid, about 0.05% of aminotris-(methylenephosphonic acid), about 1% of perfume, about 0.7% of magnesium sulfate, anhyd., about 1% of adjuvants and about 81% of water.

9. An acidic liquid microemulsion cleaner according to claim 6 which comprises 0.5 to 2% of sodium paraffin sulfonate wherein the paraffin is $C_{14-17}$, 2 to 4% of sodium ethoxylated higher fatty alcohol sulfate wherein the higher fatty alcohol is of 10 to 14 carbon atoms and which contains from 1 to 3 ethylene oxide groups per mole, 2 to 4% of nonionic detergent which is a condensation product of fatty alcohol of 9 to 15 carbon atoms with 3 to 15 moles of ethylene oxide per mole of higher fatty alcohol, 3 to 7% of an about 1:1:1 mixture of succinic, glutaric and adipic acids, 0.1 to 0.3% of phosphoric acid, 0.01 to 0.05% of aminotris-(methylenephosphonic acid), 0.09 to 0.17% of magnesium ion, 0.5 to 2% of perfume, of which at least 10% is terpene(s) and/or terpineol, 0 to 5% of adjuvant(s) and 75 to 90% of water.

10. An acidic liquid microemulsion cleaner according to claim 9 which comprises about 1% of sodium paraffin sulfonate, about 3% of sodium ethoxylated higher fatty alcohol sulfate, about 3% of nonionic detergent, about 5% of 1:1:1 mixture of succinic, glutaric and adipic acids, about 0.2% of phosphoric acid, about 0.03% of aminotris-(methylene phosphonic acid), about 0.7% of magnesium sulfate, about 1% of perfume, about 1% of adjuvants and about 85% of water.

11. A process for removing any one or more of lime scale, soap scum, and greasy soil from bathtubs or other hard surfaced items, which are acid resistant or are of zirconium white enamel, which comprises applying to such a surface a composition in accordance with claim 1, and removing such composition and the lime scale and/or soap scum and/or greasy soil from such surface.

12. A process for removing any one or more of lime scale, soap scum, and greasy soil from bathtubs or other hard surfaced items, which are acid resistant or are of zirconium white enamel, which comprises applying to such a surface a composition in accordance with claim 6, and removing such composition and the lime scale and/or soap scum and/or greasy soil from such surface.

* * * * *